US008542176B2

(12) United States Patent
Park

(10) Patent No.: US 8,542,176 B2
(45) Date of Patent: Sep. 24, 2013

(54) TIMING CONTROLLER, ERROR DETECTION METHOD OF THE TIMING CONTROLLER, AND DISPLAY DEVICE HAVING THE TIMING CONTROLLER

(75) Inventor: Jae-Hyoung Park, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1002 days.

(21) Appl. No.: 12/349,169

(22) Filed: Jan. 6, 2009

(65) Prior Publication Data

US 2009/0177930 A1 Jul. 9, 2009

(30) Foreign Application Priority Data

Jan. 7, 2008 (KR) ..... 10-2008-0001544

(51) Int. Cl.
*G09G 3/36* (2006.01)
*G09G 5/00* (2006.01)

(52) U.S. Cl.
USPC ..... 345/99; 345/94; 345/208

(58) Field of Classification Search
None
See application file for complete search history.

(56) References Cited

U.S. PATENT DOCUMENTS

2007/0085799 A1* 4/2007 Hong et al. ..... 345/94
2007/0164969 A1* 7/2007 Kim ..... 345/99

* cited by examiner

*Primary Examiner* — Andrew L Sniezek
(74) *Attorney, Agent, or Firm* — F. Chau & Associates, LLC

(57) ABSTRACT

A timing controller includes a control unit, an error signal generating unit, and an operation detecting unit. The control unit transfers a plurality of input data and outputs a plurality of completion signals according to transfer states of the respective data. The error signal generating unit generates a plurality of error signals with different waveforms, and the operation detecting unit selectively outputs one of the plurality of error signals in response to the plurality of completion signals.

19 Claims, 6 Drawing Sheets

TIMING CONTROLLER, ERROR DETECTION METHOD OF THE TIMING CONTROLLER, AND DISPLAY DEVICE HAVING THE TIMING CONTROLLER

CROSS-REFERENCE TO RELATED APPLICATION

This application claims priority to Korean Patent Application No. 10-2008-0001544 filed on Jan. 7, 2008, the disclosure of which is incorporated by reference herein.

BACKGROUND OF THE INVENTION

The present disclosure relates to a timing controller, an error detection method for the timing controller, and a display device having the timing controller, and more particularly, to a timing controller for detecting an error in an initialization operation and update operation.

A liquid crystal display (LCD) includes an LCD panel a gate driver, a data driver, and a timing controller. The LCD panel includes a thin film transistor (TFT) substrate where pixel electrodes are formed, a color filter substrate where common electrodes are formed, and a liquid crystal layer interposed between the TFT substrate and the color filter substrate. The gate driver and the data driver are configured to apply signals for display operations of the LCD panel. The timing controller is configured to generate pixel data and control signals for operations of the gate driver and the data driver.

The timing controller generally performs an initialization operation, a display operation, and an update operation in this order. The initialization operation is performed to read initialization data from an internal or external memory and set the data to allow the timing controller to operate normally. Examples of the initialization data include a resolution, a timing, a color correction, and a response time compensation. The display operation is performed to convert external input data into data necessary for image display of the LCD panel and to generate signals necessary for the gate driver and the data driver. The display operation is performed after the initialization operation is normally performed. In addition, the update operation is performed when a setting is changed during the display operation. The update operation is performed simultaneously with the display operation, and updated contents are applied to the image display in a blank period between frames.

When the initialization operation is performed normally, the timing controller generates control signals for generation of driving voltages. The driving voltages generated according to the control signals are applied to the gate driver and the data driver. In addition, the timing controller generates control signals for operations of the gate driver and the data driver. In this way, the display operation is started. When the setting is changed during the display operation, the update operation is performed simultaneously with the display operation and the updated contents are applied to the image display in a blank period between frames.

The initialization operation of the timing controller is divided into a reset period, an oscillator clock stabilization period, a resolution and timing setting period, a color correction period, a response time compensation period, and a driving voltage setting period. During the reset period, the initial state of the timing controller is stabilized. During the oscillator clock stabilization period, an oscillating unit operates normally to stabilize a clock. After the stabilization period, the timing controller performs the initialization operation.

During the resolution and timing setting period, the color correction period, the response time compensation period, and the driving voltage setting period, initialization data are read from the memory and used therein. Accordingly, the timing controller communicates with the memory, and the initialization operation is completed when the communication between the timing controller and the memory is normal. In addition, the control signals caused by the set data should be normally outputted during the driving voltage setting period.

When the communication is abnormal during any one period of the initialization operation, the control signals for generating the driving voltages are not output and the display operation is not performed. That is, it can be determined that an error occurs in the initialization operation when the control signals for generating the driving voltages are not output. However, it is impossible to determine during which period of the initialization operation the error occurs. Therefore, the respective periods of the initialization operation must be checked individually and significant time must be spent on error detection. Furthermore, since the control signals are output after the initialization operation, an error occurring during the update operation cannot be detected.

SUMMARY OF THE INVENTION

Embodiments of the present invention provide a timing controller, which can detect an error period in an initialization operation and an update operation, and an error detection method of the timing controller.

Also, embodiments of the present invention provide a timing controller, which can detect an error period in communication with a memory during an initialization operation and an update operation, and an error detection method of the timing controller.

Further, embodiments of the present invention provide a timing controller, which can set error signals with various waveforms according to error periods and detect the respective error periods by outputting error signals set according to the error periods, and an error detection method of the timing controller.

Furthermore, embodiments of the present invention provide an LCD having a timing controller, which can set error signals with various waveforms according to error periods and detect the respective error periods by outputting the error signals set according to the error periods.

In accordance with an exemplary embodiment of the present invention, a timing controller includes: a control unit configured to transfer a plurality of input data and output a plurality of completion signals according to transfer states of the respective data; an error signal generating unit configured to generate a plurality of error signals with different waveforms; and an operation detecting unit configured to selectively output one of the plurality of error signals in response to the plurality of completion signals.

The timing controller may further include an oscillating unit configured to receive power to generate a clock with a predetermined frequency, and output a stabilization signal to the operation detecting unit when the clock is stabilized.

The timing controller may further include: a setting unit configured to receive setting data, including timing and resolution data, through the control unit and set a variety of data necessary for operation of the liquid crystal display (LCD) panel; and a control signal generating unit configured to generate control signals for controlling a gate driver and a data driver by using the setting data of the setting unit.

The timing controller may further include a color correcting unit configured to output corrected pixel data, which are corrected pixel data of a current frame by referring to color correction data input through the control unit.

The timing controller may further include: a response time compensating unit configured to receive response time compensation data through the control unit, compare pixel data of a current frame with pixel data of a previous frame, and compensate a response time by referring to the response time compensation data; and a driving control unit configured to generate a control signal for generating a driving voltage by using voltage data.

The response time compensating unit may further receive the corrected pixel data.

The operation detecting unit may include at least one selecting unit configured to output the error signals with the different waveforms according to the stabilization signal of the oscillating unit or the completion signals.

The at least one selecting unit comprises a selecting unit of the first stage, a selecting unit of the last stage, and one or more selecting units disposed between the selecting unit of the first stage and the selecting unit of the last stage. The selecting unit of the first stage may selectively output the output signal of the oscillating unit or an output signal of the selecting unit of next stage of the first stage, the selecting unit of the last stage may selectively output one completion signal or one error signal, and each of the one or more selecting units disposed between the selecting unit of the first stage and the selecting unit of the last stage may output the error signal or the output signal of the selecting unit of next stage according to the completion signal.

In accordance with an exemplary embodiment of the present invention, an error detection method of a timing controller includes: generating a plurality of error signals with different waveforms; transferring a plurality of input data, and outputting a plurality of completion signals according to transfer states of the respective data; and selectively outputting one of the plurality of error signals in response to the plurality of completion signals.

The error detection method may further include: generating a clock signal before the error signals are generated; and detecting whether the clock signal is stabilized.

The data may include at least one of timing and resolution data, color correction data, response time compensation data, driving voltage data, and update data, and the data are sequentially transferred.

In accordance with an exemplary embodiment of the present invention, a display device includes: a display panel configured to display an image; a timing controller configured to receive a plurality of data to output error signals according to transfer states of the data, process an external input image signal, and generate a plurality of control signals; a driving voltage generator configured to generate a plurality of driving voltages according to the control signals of the timing controller; a gate driver configured to apply the driving voltages generated from the driving voltage generator to gate lines; and a data driver configured to generate data signals by using the driving voltages generated from the driving voltage generator, and apply the data signals to data lines.

The display panel may include: a plurality of gate lines; a plurality of data lines intersected with the plurality of gate lines; and a plurality of pixels connected to the corresponding gate lines and the corresponding data lines.

The timing controller may be configured to output one of the plurality of error signals with the different waveforms in response to a plurality of completion signals generated according to the transfer states of the data.

The timing controller may be configured to further output a state signal according to an oscillator clock stabilization.

BRIEF DESCRIPTION OF THE DRAWINGS

Exemplary embodiments of the present invention will become apparent by reference to the following description taken in conjunction with the accompanying drawings, wherein.

DETAILED DESCRIPTION OF EXEMPLARY EMBODIMENTS

Figure 1:
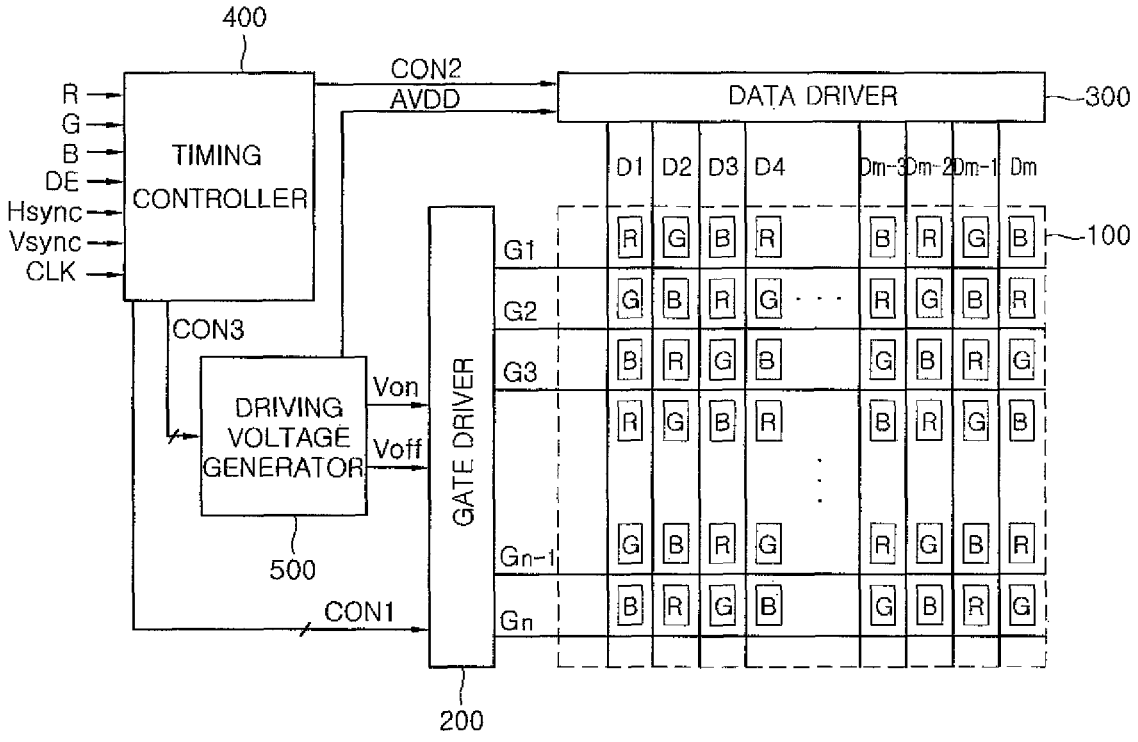
FIG. 1 is a schematic block diagram of an LCD in accordance with an exemplary embodiment of the present invention.

Hereinafter, exemplary embodiments of the present invention will be described in detail with reference to the accompanying drawings. The present invention may, however, be embodied in different forms and should not be construed as being limited to the embodiments set forth herein. Rather, these embodiments are provided so that this disclosure will be thorough and complete, and will fully convey the scope of the present invention to those skilled in the art. In the figures, like reference numerals refer to like elements throughout.

Figure 2:
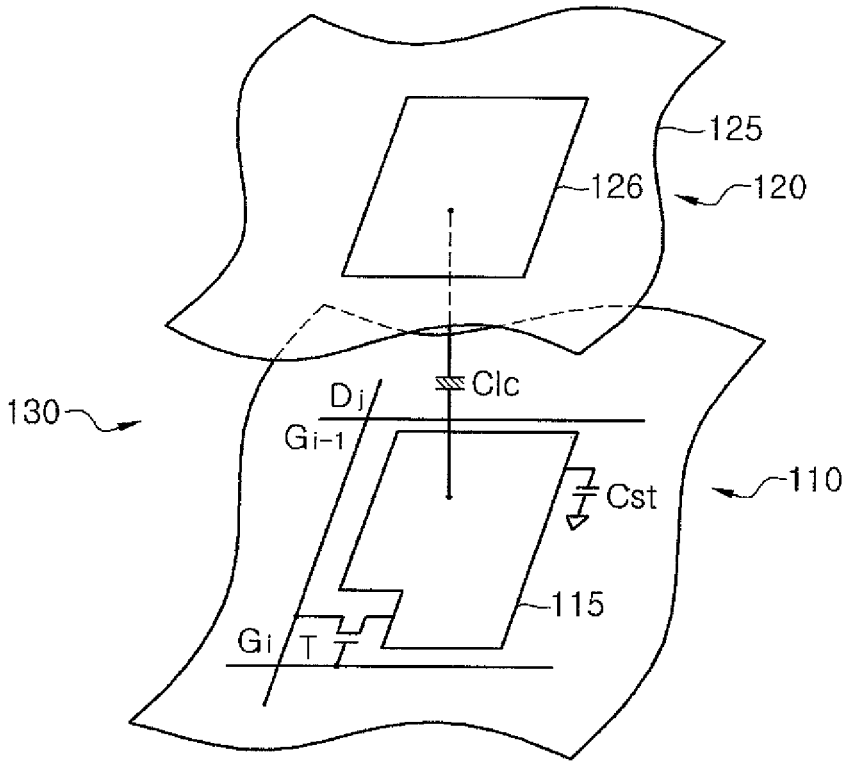
FIG. 2 is an equivalent circuit diagram of a pixel in the LCD of FIG. 1.

FIG. 1 is a block diagram of an LCD in accordance with an exemplary embodiment of the present invention, and FIG. 2 is an equivalent circuit diagram of a pixel in the LCD of FIG. 1.

Referring to FIGS. 1 and 2, the LCD in accordance with an exemplary embodiment of the present invention includes a LCD panel 100, a gate driver 200, a data driver 300, a timing controller 400, and a driving voltage generator 500. The LCD panel 100 displays an image and includes a plurality of gate lines G1-Gn, a plurality of data lines D1-Dm, a plurality of TFTs T, a plurality of liquid crystal capacitors Clc, and a plurality of storage capacitors Cst. The gate lines G1-Gn and the data lines D1-Dm are intersected with one another. The TFTs T, the liquid crystal capacitors Clc, and the storage capacitors Cst are connected to the corresponding gate lines G1-Gn and the corresponding data lines D1-Dm. The gate driver 200 is connected to the gate lines G1-Gn to control the operations of the TFTs T. The data driver 300 controls data signals applied to the liquid crystal capacitors Clc and the storage capacitors Cst through the TFTs T. The timing controller 400 controls the gate driver 200 and the data driver 300 by using external control signals R, G, B, DE, Hsync, Vsync and CLK. The driving voltage generator 500 generates the driving voltages Von, Voff and AVDD to the gate driver 200 and the data driver 300 according to the output signals of the timing controller 400.

The LCD panel 100 includes the plurality of gate lines G1-Gn extending in one direction, the plurality of data lines D1-Dm extending in a direction perpendicular to the gate lines G1-Gn, and a pixel region defined at the respective intersections of the gate lines G1-Gn and the data lines D1-Dn. Pixels each having the TFT T, the storage capacitor Cst, and the liquid crystal capacitor Clc are provided in the pixel region. The pixels include a red (R) pixel, a green (G) pixel, and a blue (B) pixel. For example, the R pixel, the G pixel, and the B pixel are sequentially arranged in odd-numbered rows, and the B pixel, the R pixel, and the G pixel are sequentially arranged in even-numbered rows. In addition to this pixel arrangement, other pixel arrangements are also possible. The LCD panel 100 includes a TFT substrate 110, a common electrode substrate 120, and liquid crystals 130. The TFT substrate 110 includes the TFTs T, the gate lines G1-Gn, the data lines D1-Dm, and the pixel electrodes 115. The common electrode substrate 120 includes a black matrix, a color filter 126, and a common electrode 125. The liquid crystals 130 are provided between the TFT substrate 110 and the common electrode substrate 120.

The respective TFTs T have gates connected to the gate lines G1-Gn, sources connected to the data lines D1-Dm, and drains connected to the pixel electrodes 115. When the TFTs T operate in response to the gate driving signals applied to the gate lines G1-Gn and the data signals are applied through the data lines D1-Dm to the pixel electrodes, electric fields across the liquid crystal capacitors Clc are changed. Due to the changed electric fields, the arrangement of the liquid crystals 130 inside the LCD panel 100 is changed and thus the transmittance of light supplied from a backlight (not shown) is controlled.

In addition, the pixel electrodes 115 may include a plurality of slit and/or protrusion patterns (not shown) as a domain control unit for controlling the arrangement direction of the liquid crystals 130, and the common electrodes 125 also may include slit and/or protrusion patterns (not shown).

The gate driver 200, the data driver 300, the timing controller 400, and the driving voltage generator 500 are provided outside the LCD panel 100 and supply a plurality of signals for the operation of the LCD panel 100. The gate driver 200 may be formed on the LCD panel 100. The data driver 300 may be mounted on the LCD panel 100, or may be mounted on a separate printed circuit board (PCB) and electrically connected to the PCB panel 100 through a flexible printed circuit board (FPC). The timing controller 400 and the driving voltage generator 500 may be mounted on a PCB and electrically connected to the LCD panel 100 through a FPC.

The timing controller 400 receives image data and display control signals from an external graphic controller (not shown). The image data include pixel data R, C and B, and the display control signals include a horizontal sync signal Hsync, a vertical sync signal Vsync, a main clock CLK, and a data enable signal DE. The timing controller 400 performs an initialization operation, a display operation, and an update operation in this order. The initialization operation includes reading initialization data from an internal or external memory and setting the data to allow the timing controller 400 to operate. Examples of the initialization data include a resolution, a timing, a color correction, a response time compensation, and a driving voltage setting.

The initialization operation is divided into a reset period, an oscillator clock stabilization period, a resolution and timing setting period, a color correction period, a response time compensation period, and a driving voltage setting period. During the reset period, internal components of the timing controller 400 are set to predetermined states so as to stabilize the initial state of the timing controller 400. During the oscillator clock stabilization period, an oscillating unit operates normally to stabilize a clock and then a start signal START of, e.g., a high level, is output. Thereafter, the timing controller 400 performs the initialization operation. At this point, if the start signal START of a low level is output even after the oscillator clock stabilization period, it is determined as an error of the oscillating unit.

During the resolution and timing setting period, the color correction period, the response time compensation period, and the driving voltage setting period, initialization data are read from the memory and used therein. However, if the initialization data from the memory are not normally transferred to the timing controller 400, the timing controller 400 does not operate normally. Accordingly, the initialization period when the initialization data from the memory are not normally transferred to the timing controller 400 should be detected. To this end, a plurality of error signals with different waveforms are generated from inside or outside of the timing controller 400, and the initialization data according to the resolution and timing setting period, the color correction period, the driving voltage setting period are transferred in sequence.

Completion signals indicating the transfer states of the initialization data in the respective periods of the initialization operation are detected, and the periods when the initialization data are not normally transferred are detected. Then, error signals according to the periods are output. In this way, the error periods of the initialization operation are externally detected by checking the waveforms of the error signals.

After the initialization operation is completed, the display operation is performed. The display operation is to process the pixel data R, C and B according to the operation conditions of the LCD panel 100 and generate a gate control signal CON1 and a data control signal CON2 respectively to the gate driver 200 and the data driver 300.

The gate control signal CON1 includes a vertical sync start signal indicating the output start of a gate turn-on voltage Von, a gate clock signal for controlling an output timing of the gate turn-on voltage Von, and an output enable signal for controlling a duration of the gate turn-on voltage Von. The data control signal CON2 includes a horizontal sync start signal indicating the transfer start of the pixel data, a load signal instructing the loading of a data voltage on the corresponding data line, an inversion signal for inverting a polarity of a gray scale voltage with respect to a common voltage, and a data clock signal.

When a setting is changed during the display operation, the update operation is performed simultaneously with the display operation. In the update operation, update data stored in the memory are received and applied to the image display in a blank period between frames. In this way, the update operation is also performed while receiving the update data stored in the memory. When the update data are not normally transferred, the update operation is not performed. Thus, the update data are not applied to the display operation, or the display operation is not performed. Therefore, in order to detect the update error, the completion signals indicating the transfer state of the update data in the update operation are detected, and error signals with predetermined waveforms are output when the update data are not normally transferred. Consequently, the update error can be detected by externally checking the waveforms of the error signals.

The driving voltage generator 500 generates a variety of driving voltages necessary for the operation of the LCD by using external voltages supplied from an external power supply according to a control signal CON3 output from the timing controller 400. The driving voltage generator 500 generates the reference voltage AVDD, the gate turn-on voltage Von, the gate tun-off voltage Voff, and the common voltage.

The driving voltage generator 500 applies the gate turn-on voltage Von and the gate turn-off voltage Voff to the gate driver 200 and the reference voltage AVDD to the data driver 300 according to the control signals output from the timing controller 400. The reference voltage AVDD is used as a reference voltage to generate gray scale voltages for driving the liquid crystals.

The gate driver 200 applies the gate turn-on voltage and the gate turn-off voltage Voff to the gate lines G1-Gn according to the gate control signal CON1 output from the timing controller 500. In this way, the TFTs T can be controlled to apply the gray scale voltages to the corresponding pixels.

The data driver 300 generates the gray scale voltages by using the data control signal CON2 output from the timing controller 400 and the reference voltage AVDD output from the driving voltage generator 500, and applies the generated gray scale voltages to the data lines D1-Dm. That is, the data driver 300 converts digital pixel data, based on the reference voltage AVDD, to generate analog data signals, that is, the gray scale voltages.

The timing controller and the peripheral elements in accordance with an exemplary embodiment of the present invention will be described with reference to FIG. 3.

Figure 3:
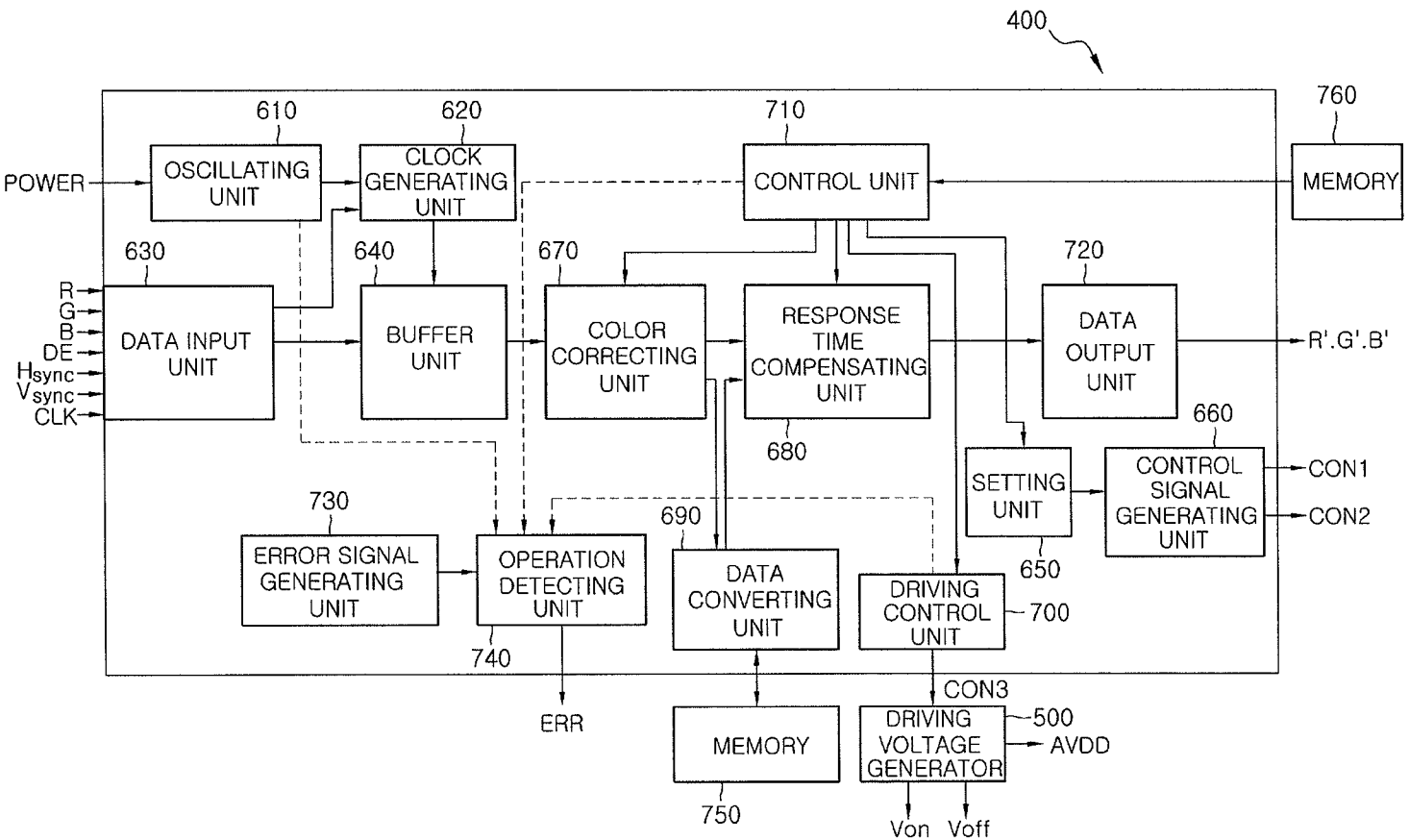
FIG. 3 is a block diagram of a timing controller in accordance with an exemplary embodiment of the present invention.

FIG. 3 is a block diagram of the timing controller and the peripheral elements in accordance with an exemplary embodiment of the present invention.

Referring to FIG. 3, the timing controller 400 includes an oscillating unit 610 that generates a basic clock signal. A clock generating unit 620 generates a variety of internal clock signals synchronized with one another by using the basic clock signal. A data input unit 630 receives external data, and a buffer unit 640 synchronizes the input data with the internal clock signal.

A setting unit 650 sets a resolution and a timing. A control signal generating unit 660 generates the control signals CON1 and CON2 by using the setting data of the setting unit 650. A color correcting unit 670 corrects color data, and a response time compensating unit 680 compensates a response time according to data conversion. A data converting unit 690 converts data formats of the inside or outside of the timing controller 400. A driving control unit 700 generates the control signal CON3 for generating the driving voltages. A control unit 710 transfers operation information of the timing controller 400. A data output unit 720 outputs internal data of the timing controller 400. In addition, an error signal generating unit 730 generates error signals having a variety of patterns. An operation detecting unit 740 detects the transfer states of the initialization data with respect to the components of the timing controller 400 and outputs error signals or normal signals according to the data transfer states.

In addition, at least one of the memories 750 and 760 is provided external to the timing controller 400. The memories 750 and 760 store a variety of data for driving the timing controller 400. The memories 750 and 760 may also be provided inside the timing controller 400. The memory 750 may be a volatile memory such as RAM, and the memory 760 may be a nonvolatile memory such as EEPROM.

The oscillating unit 610 generates the basic clock signal when power is supplied thereto. The oscillating unit 610 outputs a start signal START of, e.g., a high level, which allows the timing controller 400 to start its operation, when a predetermined time elapses from the generation of the basic clock signal. That is, after the start signal START of the high level is generated, the resolution and timing setting, the color correction, and the response time compensation of the timing controller 400 are performed in sequence.

The clock generating unit 620 receives the basic clock signal, which is output from the oscillating unit 610, and the pixel data and the control signals, which are input from the data input unit 630, and uses them to generate a variety of internal clock signals, which are synchronized with one another and used in the timing controller 400.

The data input unit 630 receives the pixel data R, G and B and the display control signals, for example, the horizontal sync signal Hsync and the vertical sync signal Vsync, from an external graphic controller (not shown). In addition, the data input unit 630 receives the data enable signal DE and the external clock signal CLK. The data input unit 630 may convert the pixel data and the control signals, which are input from the outside, into data and signals suitable for the internal formats of the timing controller 400.

The buffer unit 640 synchronizes the pixel data and the control signals input through the data input unit 630 with the internal clock signal output from the timing controller 400. That is, the buffer unit 640 synchronizes at least one internal clock signal generated from the clock generating unit 620 with the pixel data and the control signals input through the data input unit 630.

The setting unit 650 receives setup data, such as the resolution and timing data stored in the memory 760 and a variety of option data, through the control unit 710 and uses the setup data to set the resolution, the timing, and a variety of options necessary for the operation of the LCD panel 100.

The control signal generating unit 660 receives the setting data stored in the setting unit 650 and uses the setting data to generate the gate control signal CON1 for controlling the gate driver 200 and the data control signal CON2 for controlling the data driver 300.

The color correcting unit 670 receives the color correction data from the memory through the control unit 710 and stores the received color correction data. In addition, the color correcting unit 670 receives the pixel data R, G and B and corrects the received pixel data R, G and B by using the stored color correction data. That is, after storing the color correction data, the color correction unit 670 corrects at least one of the R data, the G data, and the B data by using the color correction data. At this point, the color correction data are previously determined and stored according to the characteristics of the LCD panel 100 in its manufacturing process.

The response time compensating unit 680 compares data of a previous frame with data of a current frame and reduces time necessary to convert the data of the current frame. Since the response time of the LCD panel 100 is slower than the variation of the applied voltage, the operation of the LCD panel 100 is not completely changed even though the data has been changed. Therefore, an overdriving is performed to further change the data so as to approach the response time of the LCD panel 100. To this end, the response time compensating unit 680 receives the pixel data of the previous frame stored in the memory 750 through the data converting unit 690, compares it with the pixel data of the current frame corrected by the color correcting unit 670, and then compensates the response time. At this point, the degree of the overdriving is previously set. The response time compensation data are stored in the memory 760. Therefore, the response time compensating unit receives the response time compensation data from the memory 760 through the control unit 710, stores the received response time compensation data, and then compensates the response time. In addition, after the display operation, the response time compensating unit 680 updates the response time compensation data in the updated operation such as the data conversion. In this case, the response time compensating unit 680 also receives the update data stored in the memory 760 through the control unit 710 and stores the received updated data.

The data converting unit 690 converts the color data corrected by the color correcting unit 670 according to the data format of the memory 750 and stores the converted data in the memory 750. The data converting unit 690 converts the color data stored in the memory 750 according to the data format of the timing controller 400 and transfers the converted data to the response time compensating unit 680. In addition, the data converting unit 690 converts the data synchronized with the internal clock signal by the buffer 640 into a data format of the memory 750 according to the structure of the timing controller 400, and stores the converted data in the memory 750. The data converting unit 690 converts the synchronized data stored in the memory 750 into a data format of the timing controller 400, and transfers the converted data to the color correcting unit 670.

The driving control unit 700 applies the control signals to the driving voltage generator 500 and controls the driving voltage generator 500 to generate the gate turn-on voltage Von, the gate turn-off voltage Voff, and the reference voltage AVDD. To this end, the driving control unit 700 receives the voltage data stored in the memory 760 through the control unit 710, and stores the received voltage data. The driving control unit 700 outputs the control signals by using the voltage data and controls the driving voltage generator 500 to generate analog voltages. In addition, the driving control unit 700 outputs, to the operation detecting unit 730, the signals indicating if the control signals according to the voltage data are normally transferred to the driving voltage generator 500.

The control unit 710 transfers the various data stored in the memory 760 to the respective components of the timing controller 400, and transfers the resulting signals, e.g., the completion signal Done, to the operation detecting unit 740. That is, the control unit 710 transfers the resolution and timing data and the variety of option data to the setting unit 650, and transfers the color correction data to the color correcting unit 660. The control unit 710 transfers the response time compensation data and the update data to the response time compensating unit 680. In addition, the control unit 710 transfers the driving data to the driving control unit 700. The control signals according to the transfer results are output to the operation detecting unit 740.

The data output unit 720 transfers, to the data driver 300, the pixel data R', G' and B' that are adjusted according to the conditions of the LCD panel 100 by correcting colors at the color correcting unit 670 and compensating the response time at the response time compensating unit 680.

Figure 4:
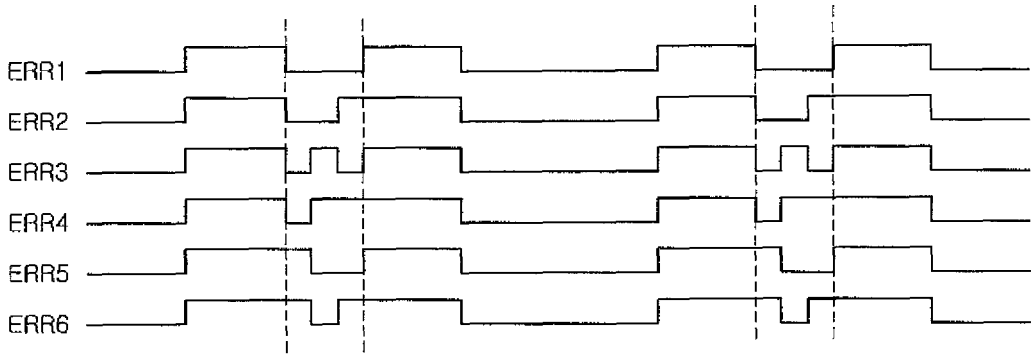
FIG. 4 is a waveform diagram of error signals in accordance with an exemplary embodiment of the present invention.

The error signal generating unit 730 generates a plurality of error signals ERR with different waveforms. For example, the error signal generating unit 730 generates first through sixth error signals ERR1 through ERR6 having different waveforms in one period as illustrated in FIG. 4. The first through sixth error signals ERR1 through ERR6 generated from the error signal generating unit 730 are input to the operation detecting unit 740. The error signal generating unit 730 may also be provided outside the timing controller 400.

Figure 5:
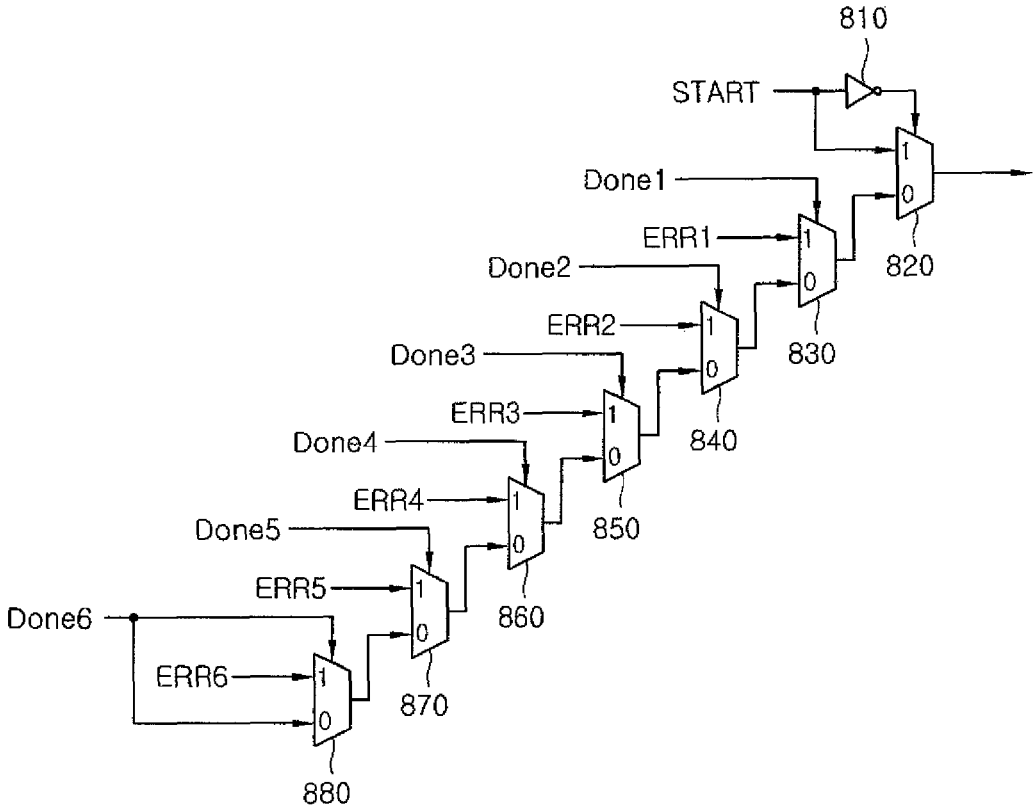
FIG. 5 is a block diagram of an operation detecting unit in accordance with an exemplary embodiment of the present invention.

The operation detecting unit 740 detects the start signal START according to the clock stabilization of the oscillating unit 610, and the completion signals Done according to whether data are normally transferred to the setting unit 650, the color correcting unit 670, the response time compensating unit 680, and the driving control unit 700, whether the control signals are normally transferred to the driving control unit 700 and the driving voltage generator 500, and whether the update data are normally transferred to the response time compensating unit 680. To this end, as illustrated in FIG. 5, the operation detecting unit 740 may include a plurality of selecting units for selectively outputting the plurality of error signals ERR1 through ERR6 having different waveforms according to the start signal START and the completion signals or the output signals of the different components. The selecting units of the operation detecting unit 740 may be implemented with multiplexers that respectively output the error signals ERR or the output signals of the next stages.

The memory 750 is implemented with a volatile memory such as DRAM, and stores the color data corrected by the color correcting unit 670. The memory 750 may also store the data synchronized with the internal clock signals by the buffer unit 640 according to the structure of the timing controller 400.

The memory 760 is implemented with a nonvolatile memory such as EEPROM, and stores the resolution and timing data, the option data, the color data, the response time compensation data, and the voltage data.

FIG. 5 is a block diagram of the operation detecting unit in accordance with an exemplary embodiment of the present invention.

Referring to FIG. 5, the operation detecting unit includes an inverter 810 and a plurality of selecting units 820 through 880. The inverter 810 inverts the start signal START output from the oscillating unit 610. The first selecting unit 820 outputs the start signal START or the output signal of the second selecting unit 830 in response to the output signal of the inverter 810.

The second selecting unit 830 outputs the first error signal ERR1 or the output signal of the third selecting unit 840 in response to the first completion signal Done1 generated according to the data transfer state with respect to the setting unit 650. The third selecting unit 840 outputs the second error signal ERR2 or the output signal of the fourth selecting unit 850 in response to the second completion signal Done2 generated according to the data transfer state with respect to the color correcting unit 670.

The fourth selecting unit 850 outputs the third error signal ERR3 or the output signal of the fifth selecting unit 860 in response to the third completion signal Done3 generated according to the data transfer state with respect to the response time compensating unit 680. The fifth selecting unit 860 outputs the fourth error signal ERR4 or the output signal of the sixth selecting unit 870 in response to the fourth completion signal Done4 generated according to the data transfer state with respect to the driving control unit 700.

The sixth selecting unit 870 outputs the fifth error signal ERR5 or the output signal of the seventh selecting unit 880 in response to the fifth completion signal Done5 generated according to the data transfer state with respect to the driving voltage generating unit 500. The seventh selecting unit 880 outputs the sixth error signal ERR6 or the sixth completion signal Done6 in response to the sixth completion signal Done6 generated according to the transfer state of the update data with respect to the response time compensating unit 680 during the updated operation.

The inverter 810 inverts the start signal START output according to the clock stabilization of the oscillating unit 610, and the first selecting unit 820 selectively outputs the start signal START or the output signal of the second selecting unit 830 according to the output signal of the inverter 810. That is, the first selecting unit 820 outputs the start signal START when the inverter 810 outputs a high level signal, and outputs the output signal of the second selecting unit 830 when the inverter 810 outputs a low level signal. At this point, the start signal START of a high level is output when the oscillating unit 610 operates normally, and the start signal START of a low level is output when the oscillating unit 610 operates erroneously. Therefore, when the inverter 810 outputs the high level signal, the first selecting unit 820 outputs the start signal START of a low level and thus the error of the oscillating unit 610 is detected. On the other hand, when the inverter 810 outputs the low level signal, the first selecting unit 820 outputs the output signal of the second selecting unit 830. Thus, the oscillating unit 610 operates normally, and it is determined that an error occurs at other portions according to the waveform of the output signal of the second selecting unit 830.

The second selecting unit 830 selectively outputs the first error signal ERR1 or the output signal of the third selecting unit 840 according to the first completion signal Done1. The first completion signal Done1 is generated from the control unit 710. Using the first completion signal Done1, it is determined whether the setting data, such as the timing and resolution data and the variety of option data, are normally transferred to the setting unit 650. For example, the control unit 710 outputs the first completion signal Done1 of a low level when the setting data are normally transferred to the setting data 650, and outputs the first completion signal Done1 of a high level when the setting data are not normally transferred to the setting unit 650. Therefore, the second selecting unit 830 outputs the first error signal ERR1 when the first completion signal Done1 of the high level is input, and outputs the output signal of the third selecting unit 840 when the first completion signal Done1 of the low level is input. That is, the second selecting unit 830 outputs the first error signal ERR1 when it is determined that the setting data are not normally transferred to the setting unit 650, and outputs the output signal of the third selecting unit 840 when it is determined that the setting data are normally transferred to the setting unit 650. In addition, the output signal of the second selecting unit 830 is transferred to one input terminal of the first selecting unit 820.

The third selecting unit 840 selectively outputs the second error signal ERR2 or the output signal of the fourth selecting unit 850 according to the second completion signal Done2. The second completion signal Done2 is generated from the control unit 710. Using the second completion signal Done2, it is determined whether the color correction data are normally transferred to the color correcting unit 670. For example, the control unit 710 outputs the second completion signal Done2 of a low level when the color correction data are normally transferred to the color correcting unit 670, and outputs the second completion signal Done2 of a high level when the color correction data are not normally transferred to the color correcting unit 670. Therefore, the third selecting unit 840 outputs the second error signal ERR2 when the second completion signal Done2 of the high level is input, and outputs the output signal of the fourth selecting unit 850 when the second completion signal Done2 of the low level is input. That is, the third selecting unit 840 outputs the second error signal ERR2 when it is determined that the color correction data are not normally transferred to the color correcting unit 670, and outputs the output signal of the fourth selecting unit 850 when it is determined that the color correction data are normally transferred to the color correcting unit 670. In addition, the output signal of the third selecting unit 840 is transferred to one input terminal of the second selecting unit 830.

The fourth selecting unit 850 selectively outputs the third error signal ERR3 or the output signal of the fifth selecting unit 860 according to the third completion signal Done3. The third completion signal Done3 is generated from the control unit 710. Using the third completion signal Done3, it is determined whether the response time compensation data are normally transferred to the response time compensating unit 680. For example, the control unit 710 outputs the third completion signal Done3 of a low level when the response time compensation data are normally transferred to the response time compensating unit 680, and outputs the third completion signal Done3 of a high level when the response time compensation data are not normally transferred to the response time compensating unit 680.

Therefore, the fourth selecting unit 850 outputs the third error signal ERR3 when the third completion signal Done3 of the high level is input, and outputs the output signal of the fifth selecting unit 860 when the third completion signal Done3 of the low level is input. That is, the fourth selecting unit 850 outputs the third error signal ERR3 when it is determined that the response time compensation data are not normally transferred to the response time compensating unit 680, and outputs the output signal of the fifth selecting unit 860 when it is determined that the response time compensation data are normally transferred to the response time compensating unit 680. In addition, the output signal of the fourth selecting unit 850 is transferred to one input terminal of the third selecting unit 840.

The fifth selecting unit 860 selectively outputs the fourth error signal ERR4 or the output signal of the sixth selecting unit 870 according to the fourth completion signal Done4. The fourth completion signal Done4 is generated from the control unit 710. Using the fourth completion signal Done4, it is determined whether the voltage data are normally transferred to the driving control unit 700. For example, the control unit 710 outputs the fourth completion signal Done4 of a low level when the voltage data are normally transferred to the driving control unit 700, and outputs the fourth completion signal Done4 of a high level when the voltage data are not normally transferred to the driving control unit 700.

Therefore, the fifth selecting unit 860 outputs the fourth error signal ERR4 when the fourth completion signal Done4 of the high level is input, and outputs the output signal of the sixth selecting unit 870 when the fourth completion signal Done4 of the low level is input. That is, the fifth selecting unit 860 outputs the fourth error signal ERR4 when it is determined that the voltage data are not normally transferred to the driving control unit 700, and outputs the output signal of the sixth selecting unit 870 when it is determined that the voltage data are normally transferred to the driving control 700. In addition, the output signal of the fifth selecting unit 860 is transferred to one input terminal of the fourth selecting unit 850.

The sixth selecting unit 870 selectively outputs the fifth error signal ERR5 or the output signal of the seventh selecting unit 880 according to the fifth completion signal Done5. The fifth completion signal Done5 is generated from the driving control unit 700. Using the fifth completion signal Done5, it is determined whether the control signal according to the voltage data is normally transferred from the driving control unit 700 to the driving voltage generator 500. For example, the driving control unit 700 outputs the fifth completion signal Done5 of a low level when the control signal is normally transferred to the driving voltage generator 500, and outputs the fifth completion signal Done5 of a high level when the control signal is not normally transferred to the driving voltage generator 500.

Therefore, the sixth selecting unit 870 outputs the fifth error signal ERR5 when the fifth completion signal Done5 of the high level is input, and outputs the output signal of the seventh selecting unit 880 when the fifth completion signal Done5 of the low level is input. That is, the sixth selecting unit 870 outputs the fifth error signal ERR5 when it is determined that the control signal is not normally transferred to the driving voltage generator 500, and outputs the output signal of the seventh selecting unit 880 when it is determined that the control signal is normally transferred to the driving voltage generator 500. In addition, the output signal of the seventh selecting unit 870 is transferred to one input terminal of the fifth selecting unit 860.

The seventh selecting unit 880 selectively outputs the sixth error signal ERR6 or the sixth completion signal Done6 according to the sixth completion signal Done6. The sixth completion signal Done6 is generated from the control unit 710 during the update operation. Using the sixth completion signal Done6, it is determined whether the updated data are normally transferred to the response time compensating unit 680. For example, the control unit 710 outputs the sixth completion signal Done6 of a low level when the updated data are normally transferred to the response time compensating unit 680, and outputs the sixth completion signal Done6 of a high level when the updated data are not normally transferred to the response time compensating unit 680.

Therefore, the seventh selecting unit 880 outputs the sixth error signal ERR6 when the sixth completion signal Done6 of the high level is input, and outputs the sixth completion signal Done6 when the sixth completion signal Done6 of the low level is input. That is, the seventh selecting unit 880 outputs the sixth error signal ERR6 when it is determined that the updated data are not normally transferred to the response time compensating unit 680, and outputs the sixth completion signal Done6 when it is determined that the updated data are normally transferred to the response time compensating unit 680.

The operation detecting unit 730 in accordance with the exemplary embodiment includes one inverter 610 and the plurality of selecting units 820 through 880. The selecting unit 820 selectively outputs the start signal START and the output signal of the next selecting unit 830. The selecting units 830 through 870 selectively output the error signals ERR1 through ERR5 or the output signals of the next selecting units 840 through 880 according to the completion signals Done1 through Done5, respectively. In addition, the selecting unit 880 selectively outputs the error signal ERR6 or the sixth completion signal Done6 according to the completion signal Done6. For example, when the start signal START of a high level, the first completion signal Done1 of a low level, and the second completion signal Done2 of a high level are input, the first and second selecting units 820 and 830 respectively output the output signals of their next selecting units, and the third selecting unit 840 outputs the second error signal ERR2. Therefore, the second error signal ERR2 output from the third selecting unit 840 is output to the outside through the second and first selecting units 830 and 820. At the outside, the error of the color correcting unit 670 is determined by using the waveform of the second error signal ERR2.

Therefore, the operation detecting unit 730 in accordance an exemplary embodiment of the present invention can detect the data transfer error occurring in the respective periods of the initialization operation or the update operation of the timing controller 400, and detect the error periods by outputting the set error signals. That is, when the low level signal is detected during the initialization operation, it is determined to be the error of the oscillating unit 610.

When the first error signal ERR1 is detected, it is determined to be the error of the setting unit 650. When the second error signal ERR2 is detected, it is determined as the error of the color correcting unit 670. When the third error signal ERR3 is detected, it is determined to be the error of the response time compensating unit 680 during the initialization operation. When the fourth error signal ERR4 is detected, it is determined to be the error of the driving control unit 700. When the fifth error signal ERR5 is detected, it is determined as the error signal transfer error of the driving control unit 700. Also, when the sixth error signal ERR6 is detected, it is determined to be the update error of the response time compensating unit 680. When the low level signal is detected during the update operation, it is determined to be the normal operation.

Figure 6A:
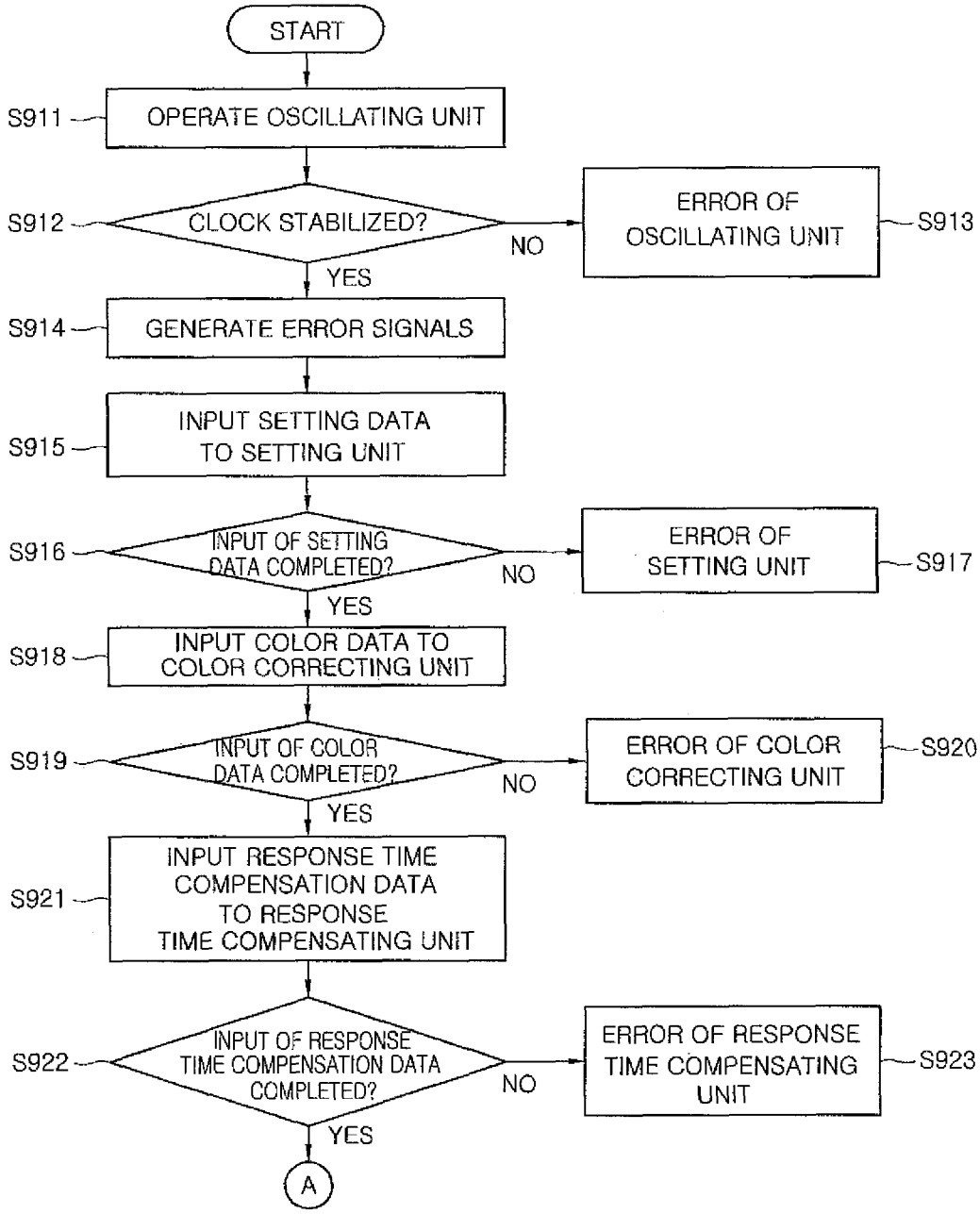
FIGS. 6(A) and 6(B) are flowcharts illustrating an error detection method of the timing controller in accordance with an exemplary embodiment of the present invention.
Figure 6B:
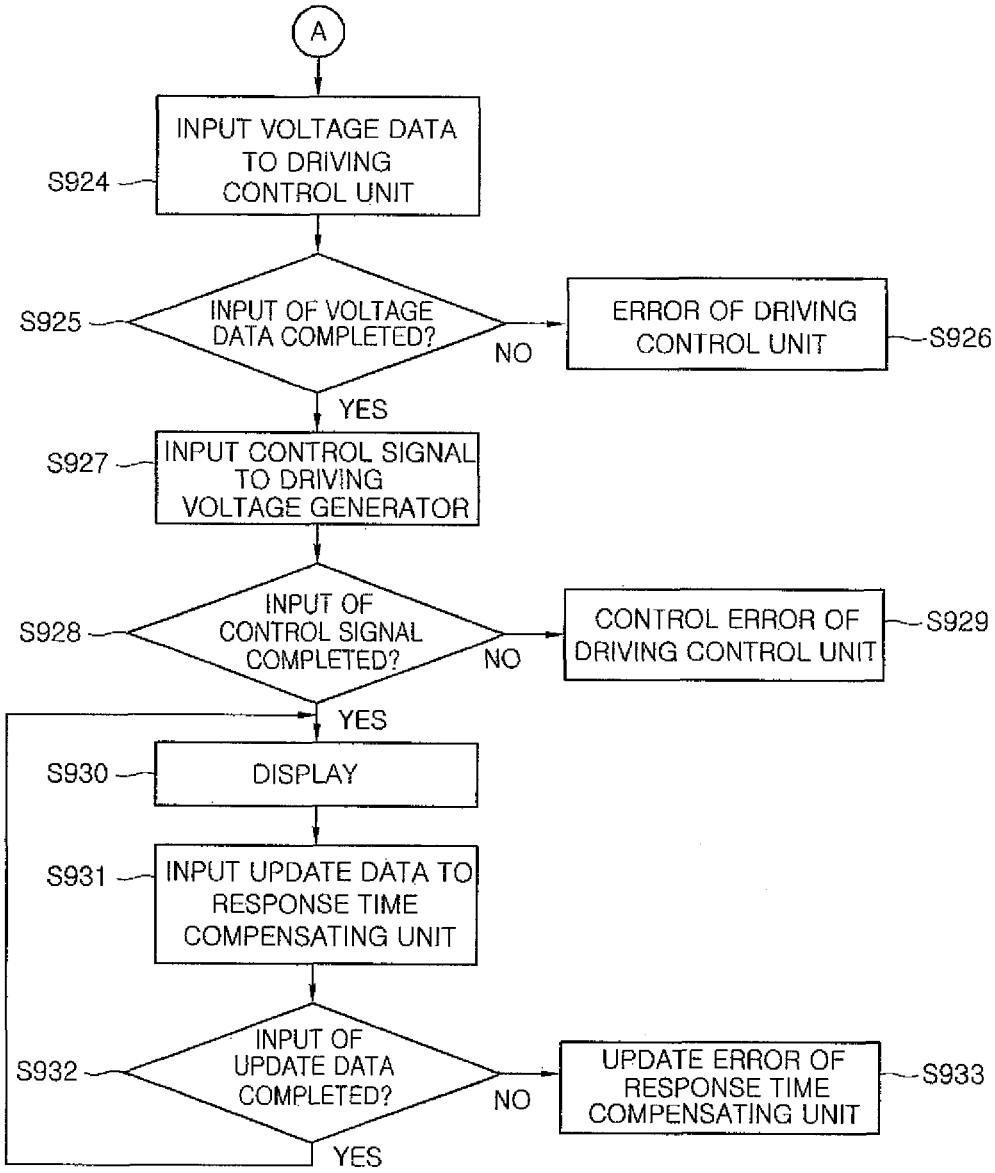

An error detection method of the timing controller in accordance with an exemplary embodiment of the present invention will be described with reference to the flowcharts of FIGS. 6(A) and 6(B), the waveform of the error signals illustrated in FIG. 4, and the internal structure diagram of the timing controller illustrated in FIG. 5. However, since the error occurring during the reset period, which is one of the initialization operations of the timing controller, is not an error occurring in the timing controller itself, but instead is a data transfer operation, the timing controller cannot detect the error. Therefore, the data transfer error detection method of the timing controller in accordance with an exemplary embodiment of the present invention will be described hereinafter.

S911: When the power is applied, the oscillating unit 610 operates to generate a predetermined clock signal. The oscillating unit 610 outputs the start signal START of, e.g., a high level, which enables the timing controller 400 to operate, when the clock signal is stabilized after a predetermined time elapses. After generating the start signal START of the high level, the timing controller 400 sequentially performs the initialization operation, including the resolution and timing setting operation, the color correction operation, and the response time compensation operation. At this point, the order of the initialization operation may be changed.

S912: The operation detecting unit 740 receives the start signal START to determine whether the clock of the oscillating unit 610 is stabilized. When the oscillating unit 610 operates so normally that the clock signal is stabilized, the start signal START of the high level is output, and the operation detecting unit 740 detects the start signal START of the high level and determines that the clock signal is stabilized. That is, when the start signal START of the high level is input, it is inverted to a low level by the inverter 810 of the operation detecting unit 740. The first selecting unit 820 outputs the output signal of the second selecting unit 830 in response to the low level signal output from the inverter 810. Therefore, the oscillating unit 810 operates normally and checks the output waveform to determine whether an error occurs due to other factors.

S913: When the start signal START of the high level is not input even after the set stabilization time, the operation detecting unit 740 determines it as the error of the oscillating unit 610. That is, when the start signal START of the low level is input, it is inverted to the high level by the inverter 810 of the operation detecting unit 740, and the first selecting unit 820 outputs the start signal START of the low level according to the high level signal output from the inverter 810. Therefore, when the low level signal is detected, it is determined as the error of the oscillating unit 810 of the timing controller 400.

S914: The signal generating unit 730 generates a plurality of error signals ERR1 through ERR6 with different waveforms according to the start signal START of the high level. The error signals ERR1 through ERR6 are respectively applied to one input terminal of the second through seventh selecting units 830 through 880. In addition, using the clock signal generated from the oscillating unit 610, the clock generating unit 620 generates a variety of clock signals used inside the timing controller 400. The data input unit 630 receives pixel data R, G and B and display control signals in each frame. The display control signals include the horizontal sync signal Hsync, the vertical sync signal Vsync, the data enable signal DE, and the external clock signal CLK. Furthermore, the buffer unit 640 synchronizes any one internal clock signal generated from the clock generating unit 620 with the pixel data and the control signal input through the data input unit 630.

S915: After the clock is stabilized, the setting unit 650 receives the setting data, such as the resolution and timing data and the variety of operation data, which are stored in the memory 760 through the control unit 710. Using the received setting data, the setting unit 650 sets the resolution, the timing, and the variety of options, which are necessary for the operation of the LCD panel 100.

S916: When the setting data stored in the memory 760 are normally transferred to the setting unit 650, the control unit 710 outputs the first completion signal Done1 of, e.g., a low level, to the operation detecting unit 730. The operation detecting unit 730 receives the first completion signal Done1 to determine whether the setting data is normally stored in the setting unit 650. That is, when the first completion signal Done1 of the low level is input, the second selecting unit 830 of the operation detecting unit 730 outputs the output signal of the third selecting unit 840 to determine that the setting data are normally stored in the setting unit 650. After the setting data are stored in the setting unit 650, the control signal generating unit 660 generates the gate control signal CON1 for controlling the gate driver 200 and the data control signal CON2 for controlling the data driver 300 by using the setting data stored in the setting unit 650.

S917: On the other hand, when the first completion signal Done1 of a high level is input to the operation detecting unit 730, the second selecting unit 830 of the operation detecting unit 740 outputs the first error signal ERR1 through the first selecting unit 820. Therefore, the first error signal ERR1 is detected externally and it is determined as the error of the setting unit 650.

S918: After the setting data are stored in the setting unit 650, the color correcting unit 670 receives the color correction data stored in the memory 760 through the control unit 710. The control unit 710 reads the color correction data from the memory 760 through 12C communication, and the color correcting unit 670 receives the color correction data from the control unit 710 and stores the received color correction data.

S919: When the color correction data of the memory 760 are normally transferred to the color correcting unit 670, the control unit 710 outputs the second completion signal Done2 of, e.g., a low level, and the operation detecting unit 740 receives the second completion signal Done2. The operation detecting unit 740 detects the second completion signal Done2 and determines whether the color correction data are normally stored in the color correcting unit 670. That is, when the second completion signal Done2 of the low level is input, the third selecting unit 840 of the operation detecting unit 740 outputs the output signal of the fourth selecting unit 850 and determines that the color correction data are normally stored in the color correcting unit 670.

After storing the color correction data, the color correcting unit 670 corrects at least one data of the R, G and B data by referring to the color correction data. The pixel data corrected by the color correcting unit 670 are transferred to the data converting unit 690, and the data converting unit 690 converts the corrected pixel data into data suitable for the format of the memory 750 and stores the converted data in the memory 750.

S920: On the other hand, when the second completion signal Done2 of a high level is input to the operation detecting unit 740, the third selecting unit 840 of the operation detecting unit 740 outputs the second error signal ERR2. The second error signal ERR2 is output through the second and first selecting units 830 and 820 to the outside. Therefore, the second error signal ERR2 is detected externally and it is determined as the error of the color correcting unit 670.

S921: After the color correction data are stored in the color correcting unit 670, the response time compensating unit 680 receives the response time compensation data stored in the memory 760 through the control unit 710.

S922: When the response time compensation data of the memory 760 are normally transferred to the response time compensating unit 670, the control unit 710 outputs the third completion signal Done3 of, e.g., a low level, to the operation detecting unit 740. The operation detecting unit 740 detects the third completion signal Done3 and determines whether the response time compensation data are normally stored in the response time compensating unit 680. That is, when the third completion signal Done3 of a low level is input, the fourth selecting unit 850 of the operation detecting unit 740 outputs the output signal of the fifth selecting unit 860 and determines that the response time compensation data are normally stored in the response time compensating unit 680. The response time compensating unit 680 refers to the response time compensation data and compensates the response time by comparing the data of the previous data, which are supplied from the data converting unit 690 and stored in the memory 750, with the data of the current data, which are corrected by the color correcting unit 670.

S923: On the other hand, when the third completion signal Done3 of a high level is input to the operation detecting unit 740, the fourth selecting unit 850 of the operation detecting unit 740 outputs the third error signal ERR3. Therefore, the third error signal ERR3 is externally detected and it is determined as the error of the response time compensating unit 680.

S924: After the response time compensation data are stored in the response time compensating unit 680, the driving control unit 700 receives the voltage data stored in the memory 760 through the control unit 710.

S925: When the voltage data of the memory 760 are normally transferred to the driving control unit 700, the control unit 710 outputs the fourth completion signal Done4 of, e.g., a low level, to the operation detecting unit 740. The operation detecting unit 740 detects the fourth completion signal Done4 and determines whether the voltage data are normally stored in the driving control unit 700. That is, when the fourth completion signal Done4 of the low level is input, the fifth selecting unit 860 of the operation detecting unit 740 outputs the output signal of the sixth selecting unit 870 and determines that the voltage data are normally stored in the driving control unit 700.

S926: On the other hand, when the fourth completion signal Done4 of a high level is input to the operation detecting unit 740, the fifth selecting unit 860 of the operation detecting unit 740 outputs the fourth error signal ERR4. Therefore, the fourth error signal ERR4 is externally detected and it is determined as the error of the driving control unit 700.

S927; After the voltage data are normally input to the driving control unit 700, the driving control unit 700 generates the control signal according to the voltage data and inputs it to the driving voltage generator 500.

S928: When the control signal according to the voltage data is normally input to the driving voltage generator 500, the driving control unit 700 outputs the fifth completion signal Done5 of, e.g., a low level, the operation detecting unit 740 receives the fifth completion signal Done5. The operation detecting unit 740 detects the fifth completion signal Done5 and determines whether the control signal is normally input to the driving voltage generator 500. That is, when the fifth completion signal Done5 of the low level is input, the sixth selecting unit 870 of the operation detecting unit 740 outputs the output signal of the seventh selecting unit 880 and determines that the driving control unit 700 normally inputs the control signal to the driving voltage generator 500.

S929: On the other hand, when the fifth completion signal Done5 of a high level is input to the operation detecting unit 740, the sixth selecting unit 870 of the operation detecting unit 740 outputs the fifth error signal ERR5. Therefore, the fifth error signal ERR5 is externally detected and it is determined as the control error of the driving control unit 700.

S930: When the control signal according to the voltage data is normally input from the driving control unit 700 to the driving voltage generator 500, the driving voltage generator 500 generates the gate turn-on voltage Von, the gate turn-off voltage Voff and the reference voltage AVDD. Then, the gate turn-on voltage Von, the gate turn-off voltage Voff, and the reference voltage AVDD are input to the gate driver 200 and the data driver 300, and the corrected pixel data R', G' and B' are input from the data output unit 720 to the data driver 300. Therefore, the display operation is performed.

S931: When the update operation such as the data conversion is performed after display operation, the response time compensating unit 680 receives the update data stored in the memory 760 through the control unit 710.

S932: When the update data of the memory 760 are normally transferred to the response time compensating unit 670, the control unit 710 outputs the sixth completion signal Done6 of, e.g., a low level, to the operation detecting unit 740. The operation detecting unit 740 detects the sixth completion signal Done6 and determines whether the update data are normally stored in the response time compensating unit 680. That is, when the sixth completion signal Done6 is input, the seventh selecting unit 880 of the operation detecting unit 740 outputs the sixth completion signal Done6 of the high level and determines that the update data are normally stored in the response time compensating unit 680. The update display is performed by referring to the update data of the response time compensating unit 680.

S933: On the other hand, when the sixth completion signal Done6 of a high level is input to the operation detecting unit 740, the seventh selecting unit 880 of the operation detecting unit 740 outputs the sixth error signal ERR6. Therefore, the sixth error signal ERR6 is externally detected and it is determined as the update error of the response time compensating unit 680.

Although it has been described in the exemplary embodiment that the plurality of error signals are generated after the clock signal of the oscillating unit 610 is stabilized and the start signal START of the high level is output, the plurality of error signals may be generated without regard to the start signal START. In addition, the error signals may be generated outside the timing controller 400. That is, the error signals may be generated outside the timing controller 400 and input through the data input unit 630 according to the start signal START. Then, the error signals may be synchronized in the buffer unit 640 and then supplied to the operation detecting unit 740.

Furthermore, in addition to the error signals, other error signals with various patterns may also be generated, and various errors can also be detected.

Although an LCD has been described above, the embodiments of the present invention can also be applied to other types of display devices using the timing controller.

In accordance with the exemplary embodiments of the present invention, a plurality of error signals with different waveforms are generated inside or outside the timing controller. The operation detecting unit provided inside the timing controller detects the error of the oscillating unit by using the start signal generated after the clock signal of the oscillating unit is stabilized, and outputs the different error signals according to the respective periods of the initialization operation by using the completion signals indicating whether the various data for the initialization operation are normally transferred from the memory to the timing controller.

By detecting the waveforms of the error signals at the outside of the timing controller, the error occurring in the respective periods of the initialization operation and the update operation of the timing controller can be detected separately in each operation period. Therefore, the error can be easily detected in the initialization operation or the update operation of the timing controller. Furthermore, the error detection time and the debugging time can be reduced.

Although a timing controller, an error detection method of the timing controller, and a display device having the timing controller have been described with reference to exemplary embodiments of the present invention, they are not limited thereto. Therefore, it will be readily understood by those skilled in the art that various modifications and changes can be made thereto without departing from the spirit and scope of the disclosure.

What is claimed is:

1. A timing controller, comprising: a control unit configured to transfer a plurality of input data and output a plurality of completion signals according to transfer states of the respective input data; an error signal generating unit configured to generate a plurality of error signals with different waveforms; and an operation detecting unit configured to selectively output one of the plurality of error signals in response to the plurality of completion signals.

2. The timing controller of claim 1, further comprising an oscillating unit configured to receive power to generate a clock signal with a predetermined frequency, and output a stabilization signal to the operation detecting unit when the clock signal is stabilized.

3. The timing controller of claim 2, further comprising:

a setting unit configured to receive setting data including timing and resolution data, through the control unit, and to set a variety of data necessary for operation of a liquid crystal display (LCD) panel; and a control signal generating unit configured to generate control signals for controlling a gate driver and a data driver by using the data set by the setting unit.

4. The timing controller of claim 3, further comprising a color correcting unit configured to output corrected pixel data of a current frame by referring to color correction data input through the control unit.

5. The timing controller of claim 4, further comprising:

a response time compensating unit configured to receive response time compensation data through the control unit, to compare pixel data of a current frame with pixel data of a previous frame, and to compensate a response time by referring to the response time compensation data; and a driving control unit configured to generate a control signal for generating a driving voltage by using voltage data.

6. The timing controller of claim 5, wherein the response time compensating unit further receives the corrected pixel data output from the color correcting unit.

7. The timing controller of claim 2, wherein the operation detecting unit comprises at least one selecting unit configured to output the error signals with the different waveforms according to one of the stabilization signal of the oscillating unit or the completion signals.

8. The timing controller of claim 7, wherein the at least one selecting unit comprises a selecting unit of a first stage, a selecting unit of a last stage, and one or more selecting units disposed between the selecting unit of the first stage and the selecting unit of the last stage, and wherein the selecting unit of the first stage is configured to selectively output one of the output signal of the oscillating unit or an output signal of a selecting unit of a next stage to the first stage, the selecting unit of the last stage is configured to selectively output one of one completion signal or one error signal, and at least one selecting unit provided between the selecting unit of the first stage and each of the one or more selecting units disposed between the selecting unit of the first stage and the selecting unit of the last stage is configured to output one of an error signal or an output signal of the selecting unit of the next stage according to the completion signal.

9. An error detection method of a timing controller, comprising:

generating a plurality of error signals with different waveforms;

transferring a plurality of input data, and outputting a plurality of completion signals according to transfer states of the respective input data; and selectively outputting one of the plurality of error signals in response to the plurality of completion signals.

10. The error detection method of claim 9, further comprising:

generating a clock signal before the error signals are generated; and detecting whether the clock signal is stabilized.

11. The error detection method of claim 9, wherein the data comprises at least one of timing and resolution data, color correction data, response time compensation data, driving voltage data, and updated data, and the data are sequentially transferred.

12. A display device, comprising:

a display panel configured to display an image;

a timing controller configured to receive a plurality of input data, to output error signals according to transfer states of the input data, to process an external input image signal, and to generate a plurality of control signals, wherein the timing controller is configured to output one of the error signals in response to a plurality of completion signals;

a driving voltage generator configured to generate a plurality of driving voltages according to the control signals generated by the timing controller;

a gate driver configured to apply the driving voltages generated from the driving voltage generator to gate lines of the display panel; and a data driver configured to generate data signals by using the driving voltages generated from the driving voltage generator, and to apply the data signals to data lines of the display panel, wherein the plurality of completion signals are generated according to the transfer states of the input data.

13. The display device of claim 12, wherein the display panel further comprises a plurality of pixels connected to corresponding gate lines and data lines.

14. The display device of claim 12, wherein the timing controller is configured to further output a start signal according to a stabilization of an oscillator clock.

15. The display device of claim 14, wherein the oscillator clock receives power to generate a clock signal with a predetermined frequency.

16. The display device of claim 14, wherein the display panel is a liquid crystal display panel.

17. The display device of claim 16, wherein the timing controller further includes a setting unit configured to receive setting data including timing and resolution data.

18. The display device of claim 12, wherein the plurality of control signals generated by the timing controller include a first control signal for controlling the gate driver, and a second control signal for controlling the data driver.

19. The display device of claim 12, wherein the error signals output by the timing controller are error signals with different waveforms.

* * * * *